US005684278A

United States Patent [19]

Yasukawa et al.

[11] Patent Number: 5,684,278

[45] Date of Patent: Nov. 4, 1997

[54] ACOUSTICAL CERAMIC PANEL AND METHOD

[75] Inventors: Robert Deane Yasukawa, San Jose; James Perry Woolley, Sunnyvale; Venecia M. Grobelny, San Jose, all of Calif.

[73] Assignee: Lockheed Missiles & Space Co., Inc., Sunnyvale, Calif.

[21] Appl. No.: 342,121

[22] Filed: Nov. 18, 1994

[51] Int. Cl.[6] ..... E04B 1/82

[52] U.S. Cl. ..... 181/286; 181/292; 181/294; 181/296

[58] Field of Search ..... 181/213, 222, 181/225, 210, 286, 290, 292, 294, 296; 428/116, 117, 118

[56] References Cited

U.S. PATENT DOCUMENTS

| | | | |
|---|---|---|---|
| 3,021,916 | 2/1962 | Kemp | 181/292 |
| 3,211,253 | 10/1965 | Gonzalez | 181/292 |
| 3,977,492 | 8/1976 | Hankel | 181/286 |
| 4,147,578 | 4/1979 | Koss | 181/290 X |
| 4,453,887 | 6/1984 | Schucker | 181/213 |
| 4,849,276 | 7/1989 | Bendig et al. | 181/292 X |
| 5,459,291 | 10/1995 | Haines et al. | 181/286 |
| 5,594,216 | 1/1997 | Yasukawa et al. | 181/213 |

*Primary Examiner*—Khanh Dang
*Attorney, Agent, or Firm*—Peter J. Dehlinger

[57] ABSTRACT

A rigid acoustic insulator panel for use as a sound insulator is disclosed. The panel is composed of a rigid matrix formed of randomly oriented, fused silica fibers having fiber diameters predominantly in the range between 0.5 and 2 μm. The matrix has a three-dimensionally continuous network of open, intercommunicating voids, and a density of between about 2 and 6 lb/ft$^3$. In one embodiment, the panel has greater flow resistance characteristics, progressing from a sound-absorbing side of the matrix to the opposite panel side. Also disclosed is a method of preparing the panel.

19 Claims, 7 Drawing Sheets

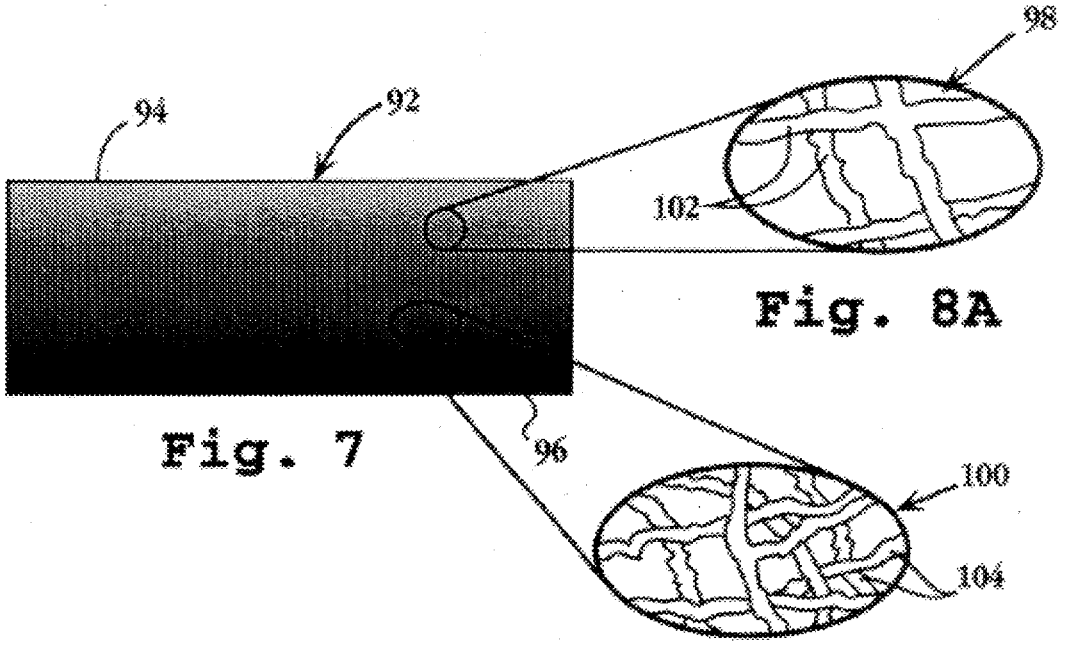
Fig. 8A
Fig. 7
Fig. 8B
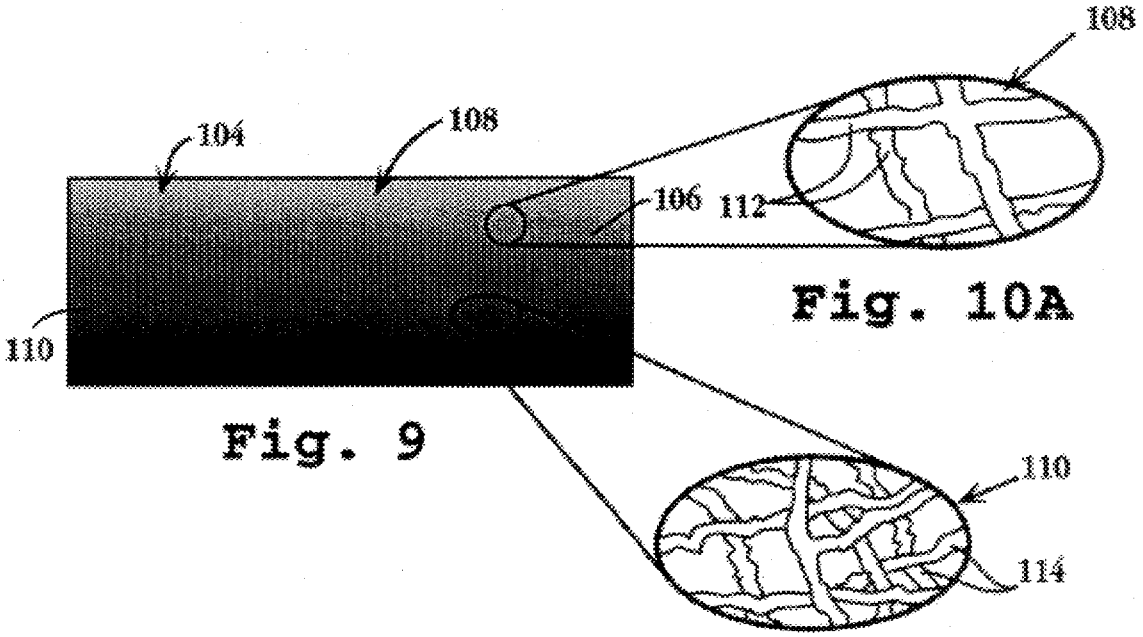
Fig. 10A
Fig. 9
Fig. 10B

ACOUSTICAL CERAMIC PANEL AND METHOD

FIELD OF THE INVENTION

The present invention relates to a lightweight, rigid, fibrous ceramic panel for acoustic sound insulation, and to a method of using and preparing the panel.

BACKGROUND OF THE INVENTION

Acoustical sound insulators are used in a variety of settings, such as vehicles, aircraft, and the like where it is desired to dampen noise from an external source. In general, such insulators should be lightweight, able to dampen sound over a wide sound-frequency spectrum, and relatively inexpensive in manufacture.

With increased competitiveness in the aircraft industry, in particular, there is an interest in aircraft fuselage insulators which are lightweight and capable of serving as an effective sound barrier to jet and high-speed air noises. For use in aircraft, the acoustical insulator material should also be able be resist the uptake of moisture over time, and provide cabin protection against fires caused by aircraft impact.

Current fuselage acoustic insulation used on civilian aircraft is fabricated from small diameter fiberglass strands held together in an organic matrix and berglass strands held together in an organic matrix and encased in a polymer film. The insulation is not water- or moisture-proof and tends to pick up significant amounts of water during use. The additional moisture pickup reduces the acoustic absorption performance and increases the aircraft's overall operational weight and cost.

Current fiberglass insulations have relatively low porosities and a narrow range of pore sizes, and are typically used in mat thicknesses of 3–5 inches. The material acts to dissipate sound, but does not form an effective sound barrier. To the extent that sound penetrates, but is not dissipated by the material, it is able to reach and pass through the interior panel of the fuselage into the passenger compartment.

SUMMARY OF THE INVENTION

The present invention includes, in one aspect, a rigid acoustic insulator panel for use as a sound insulator. The panel has a rigid matrix defining a sound-absorbing panel side and an opposite back side. The matrix (i) is formed of randomly oriented, fused silica fibers having fiber diameters predominantly in the range between 0.5 and 2 μm, (ii) has a three-dimensionally continuous network of open, intercommunicating voids, and (iii) has a density of between about 2 and 6 lb/ft$^3$.

The matrix is preferably formed of fused silica and alumina fibers, where the alumina fibers make up 10–40 percent of the total fiber weight of the matrix.

The fibers forming the matrix are preferably coated with a hydrophobic film effective to reduce water penetration into and retention in the matrix. The matrix has a preferred flow resistance between about 70–500K rayls/m.

In one general embodiment, the matrix has a lower-to-higher flow resistance gradient, progressing in a direction from the sound-absorbing to the back side of the panel. Preferably the flow resistance measured at the sound-absorbing side panel is between about 20–100K rayls/m, and at least about 50% lower than that measured at the back side.

The flow resistance gradient may be produced by a lower-to-higher density gradient across the panel, progressing in a direction from the sound-absorbing to the back side of the panel, or by a larger-to-smaller fiber diameter gradient, also progressing in a direction from the sound-absorbing to the back side of the panel.

In another aspect, the invention includes a sound-absorbing panel for use as a sound barrier. The panel includes a rigid matrix of randomly oriented, fused silica fibers which form a three-dimensionally continuous network of open, intercommunicating voids, with a matrix density between about 2 and 6 lb/ft$^3$.

The matrix has a sound-absorbing sublayer (i) whose flow resistance is between about 20–100K rayls/m, and a backing sublayer whose fiber sizes are predominantly in the 0.5 to 2 μm diameter size range, and (ii) whose flow resistance is at least 50% greater than that of the sound-absorbing sublayer.

In one general embodiment, the sublayers form a continuous gradient of flow resistance between them, produced, for example, by a continuous density gradient between the two sides of the panel.

In another general embodiment, the two sublayers form a discontinuous gradient of flow resistance between them, produced, for example, by a discontinuous density gradient or fiber-size gradient between them.

In a related aspect, the invention includes a method for reducing the level of sound entering a compartment, such as a vehicle or aircraft compartment, from an external sound source. The method includes shielding the compartment with one or more panels of the type described above, where the sound-absorbing side of the panel is disposed to confront the external sound source.

In still another aspect, the invention includes an improvement in a method for preparing a rigid, fused-silica matrix, by the steps of (a) forming a slurry composed of (i) silica fibers having selected fiber thicknesses and a selected fiber-:liquid weight ratio, (ii) a thickening agent effective to give the slurry a selected viscosity, and (iii) boron nitride particles, in an amount between about 2–12 percent by weight of the total fiber weight, where the slurry contains silica fibers, a dispersing agent effective to enhance the dispersion of silica fibers in the slurry, (b) allowing the slurry to settle in a mold under conditions effective to produce a fiber block, and (c) drying the settled block to form a substantially dehydrated fiber block, and (d) heating the dehydrated block to a temperature of at least about 2200° F. for a period sufficient to cause the silica fibers to form a fused-fiber matrix.

The improvement includes selecting fiber sizes predominantly in the 0.5 to 2 μm size range for preparing the slurry, and allowing the slurry to settle under conditions effective to produce a density gradient in the fiber block in which the lower portion of the block has a density of at least about 50% greater than that of the upper portion of the block, and the average density of the block is between about 2 and 6 lb/ft$^3$.

Alternatively, the improvement includes selecting fiber sizes predominantly in the 0.5 to 2 μm size range for preparing the slurry, allowing the slurry to at least partially settle, and adding to the at least partially settled slurry, a second slurry having fiber sizes predominantly greater than 2 μm.

These and other objects and features of the invention will become more fully apparent when the following detailed description of the invention is read in conjunction with the accompanying drawings.

BRIEF DESCRIPTION OF THE DRAWINGS

FIG. 7 is a sectional view of an acoustical panel having a continuous flow-resistance gradient, according to one embodiment of the invention;

FIGS. 8A and 8B are representations of the matrix structure in low and high density regions of the FIG. -7 matrix, respectively;

FIG. 9 is a sectional view of an acoustical panel having a discontinuous flow-resistance gradient, according to one embodiment of the invention;

FIGS. 10A and 10B are representations of the matrix structure in large-fiber-diameter and small-fiber-diameter regions of the FIG. -9 matrix, respectively.

DETAILED DESCRIPTION OF THE INVENTION

I. Acoustical Panel

The acoustic panel of the invention is designed for use as a sound barrier, typically for sound-insulating a compartment for reducing the level of noise reaching the compartment from an external noise source.

Because the panel is lightweight and able to reduce noise over a wide spectrum of sound frequencies, the panel is particularly suited for shielding the passenger compartments of high-speed vehicles and aircrafts. The use of the panel will be described below with respect to its use as a sound barrier for the passenger compartment of an aircraft, it being recognized that the invention is applicable to a variety of settings in which acoustical insulation is needed.

A. Panel Configurations

Figure 1:
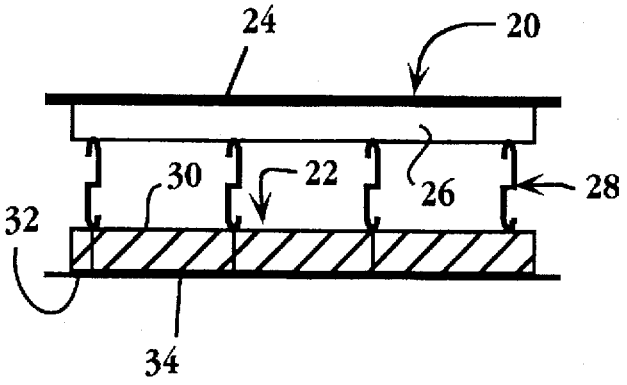
FIG. 1 is a sectional view of a portion of the fuselage passenger compartment in an aircraft, showing an acoustic panel constructed in accordance with the invention.

FIG. 1 shows a cross-sectional region of a passenger-area of an aircraft fuselage 20 containing an acoustic insulation panel 22 constructed in accordance with the invention. The fuselage conventionally includes an outer skin 24, a series of longitudinally extending stringers, such as stringers 26, and a series of circumferential frames, such as frames 28, encircling the fuselage.

In accordance with an important feature of the invention, the panel is constructed of a rigid matrix which is formed of randomly oriented, fused silica fibers having fiber diameters predominantly in the range between 0.5 and 2 μm, and a three-dimensionally continuous network of open, intercommunicating voids, as detailed below with respect to FIGS. 3A–3D. The matrix has a density of between about 2 and 6 $lb/ft^3$, where this density refers to the average bulk density of the matrix in fused form, i.e., considering the average density of the panel as a whole.

The panel has a sound-absorbing side 30 which faces the fuselage skin, and an opposite back side 32 which is attached, e.g., by adhesive attachment, to an interior wall 34 of the aircraft passenger compartment. The panel and attached wall are attached to the fuselage frames by direct attachment of the panel's sound-absorbing side to the frames, as shown. The rigid acoustical panel thus serves both as an acoustical barrier between the fuselage skin and passenger compartment, and as a structural member for attaching the interior wall to the fuselage.

Figure 2A:
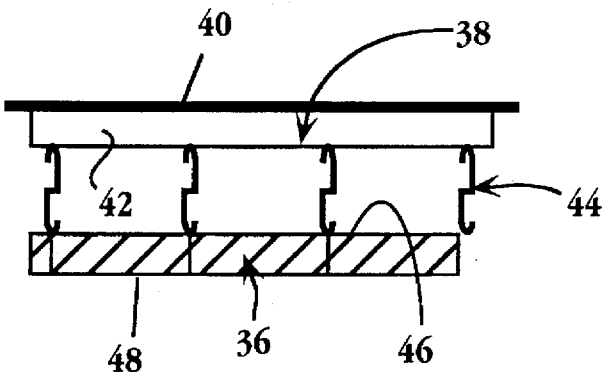
FIGS. 2A and 2B are sectional views of a portion of the fuselage non-passenger compartment in an aircraft fuselage, showing alternative means of mounting acoustical panels to a fuselage frame.

FIG. 2A shows a configuration for mounting an acoustical panel, here indicated at 36, to an aircraft fuselage 38 in a non-passenger area of the aircraft. The figure shows a fuselage skin 40, a stringer 42, and frames, such as frame 44 of the fuselage.

The panel has a sound-absorbing side 46 facing the outer skin of the aircraft, and a back side 48 which here serves as the interior wall of the non-passenger region of the aircraft compartment. As above, the panel is attached directly to associated frames of the aircraft fuselage. In other words, the configuration is identical to that in FIG. 1, except that the panel in the non-passenger compartment serves both as an acoustical insulator and as the interior wall surface of the compartment.

Figure 2B:
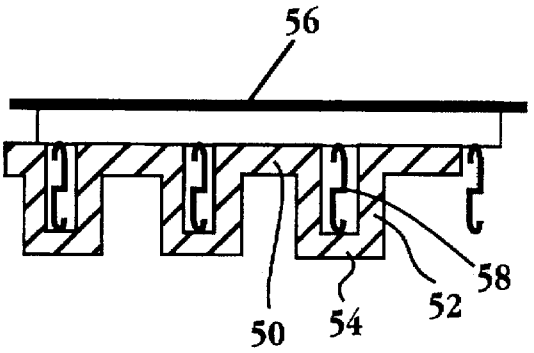

FIG. 2B shows another configuration for mounting acoustical panels, such as panels 50, 52, 54 in a non-passenger compartment region of an aircraft fuselage 54. As above, the fuselage structure includes an outer skin, stringers, such as stringer 58, and a series of frames, such as frame 60.

The panel configuration in this figure includes a series of longitudinally spaced interior panels, such as panel 50, attached directly to associated stringers, such as stringer 56, by adhesive or mechanical attachment. Each set of frames, such as the set including frame 58, is covered by a shorter frame panel, such as panel 54 attached directly to those frames. Side panels, such as panel 52, are used to fill the space between the interior and frame panels, and are attached, e.g., adhesively, to the overlapping edge portions of the interior and frame panels, as shown. Alternatively, the U-shaped members formed by the frame and adjacent side panels may be fabricated as a single piece and adhesively or mechanically attached to the associated frames.

As in FIG. 2A, the panels serve both as acoustical insulators and structural members forming the interior wall surfaces of the non-passenger region of the compartment. The sides of the panels opposite the wall-surfaces of the panels are the sound-absorbing sides of the panels.

It will be appreciated that the above configurations are representative of many different fastening and insulation configurations that may be suitable for sound insulating a chamber, such as an aircraft fuselage, a vehicle passenger compartment, or the like.

B. Panel Microstructure

FIGS. 3A–3D are scanning electron microscopy (SEM) photomicrographs of a fused-fiber matrix 60 making up the acoustical panel of the invention. The matrix is composed typically of 60–90% by weight silica fibers and 10–40% by weight alumina or alumina/silica (mullite). In the embodiment shown the matrix is composed of 80 percent of fiber weight of silica fibers and 20 percent by fiber weight of alumina fibers. A matrix of this type will be referred to herein as a fused-silica matrix, it being recognized that the matrix is composed of silica fibers or a composite of silica and alumina fibers fused with one another, typically above 2,000° F.

Figure 3A:
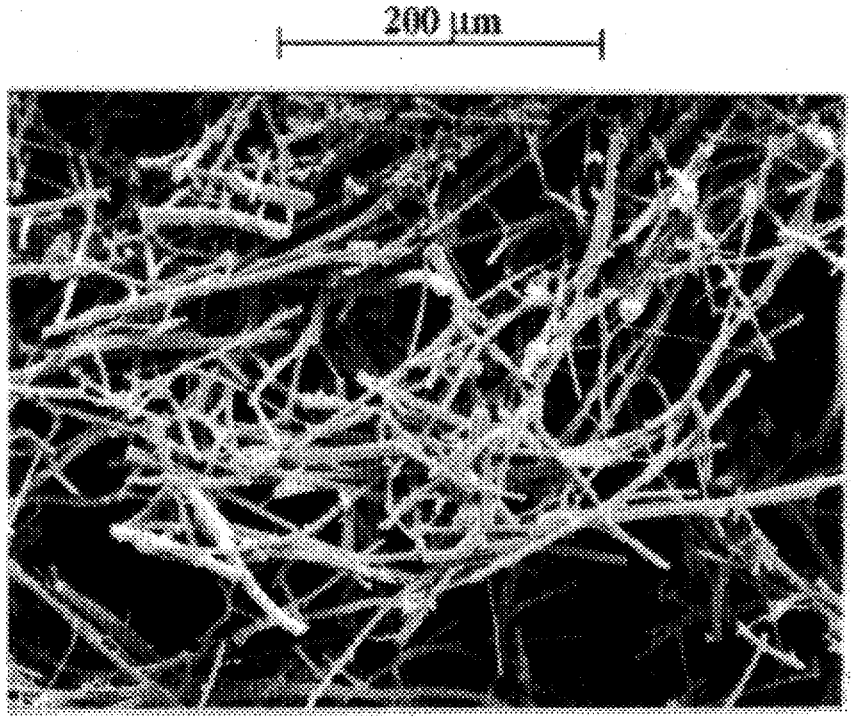
FIGS. 3A–3D show scanning electron micrographs of the FIG. 1 matrix taken at magnifications of 220 (3A), 1,000 (3B), 3,000 (3C), and 7,000 (3D)
Figure 3B:
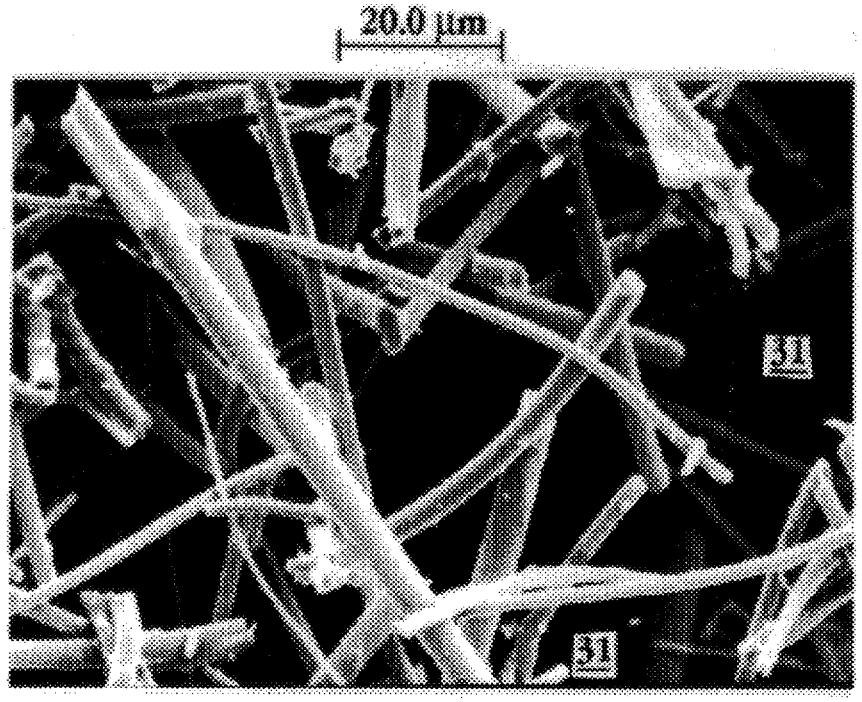

The figures are electron micrographs of the matrix taken at 200× (3A), 1,000× (3B), 2,000× (3C), and 7,000× (3D) magnification. The portion of the matrix in FIG. 3A shows a "nest" of fused silica and alumina fibers, such as fibers 62, 64, respectively, ranging in size from about 200 μm to 10 mm in length. The higher magnification SEM micrograph seen in FIG. 3B shows how the fibers are fused at their points of intersection to form a rigid fiber structure having 3-dimensionally continuous network of interconnecting voids or pores, such as pores 66, which tend to have "long" (uninterrupted) dimensions between about 10–100 μm, and short "width dimensions between about 0.1 to 5 μm. That is, the fused fibers are substantially randomly oriented, forming in all directions, interconnecting pores defined by groups of fused fibers, where the pores can range in size between about 0.1 to 100 μm depending on pore orientation and distance between adjacent fibers.

The 2,000× magnification micrograph (FIG. 3C) clearly shows both silica fibers, which are smooth surfaced, and alumina fibers, which have a textured or mottled surface. The silica fibers in the matrix, which constitute the predominant fiber species, preferably 60–90 weight percent, have diameters in the 0.5 to 2 μm size range. The alumina fibers, which preferably constitute between 10 and 40 weight percent of the matrix, may have sizes in the same range, or as shown here, larger fiber diameter sizes, e.g., 2.5–3.5 μm.

The mottled regions on the alumina fibers presumably represents grain growth that occurs during the high-temperature sintering step used in forming the matrix. Clearly visible in FIG. 3C are fusion junctions between two silica fibers, such as junction 68; fusion junctions between silica and alumina fibers, such as junction 70 between silica and alumina fibers; and fusion junctions, such as junction 72 between two alumina fibers.

Figure 3C:
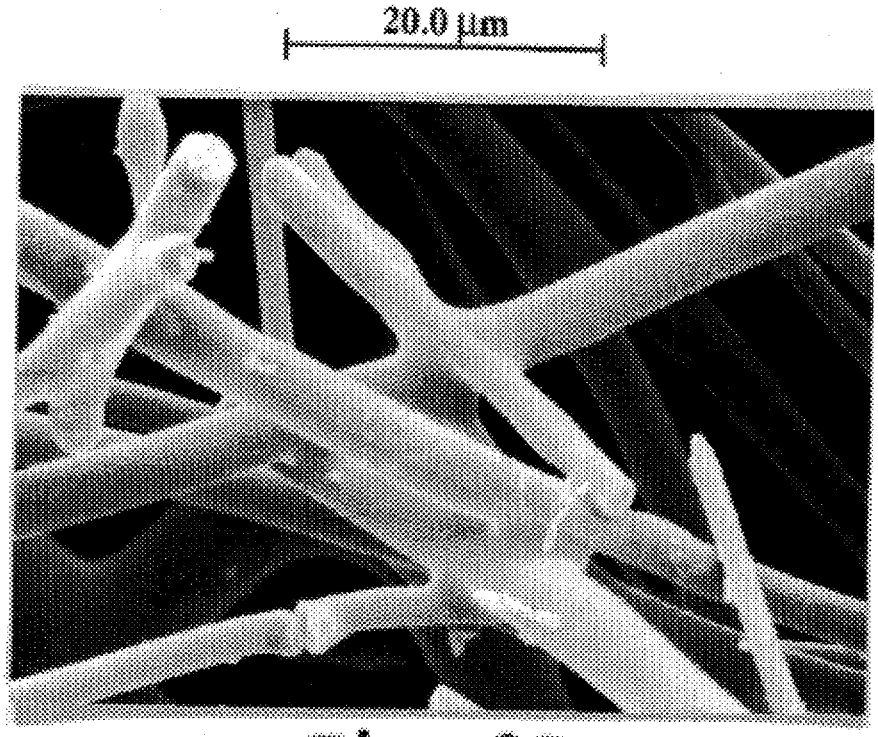
Figure 3D:
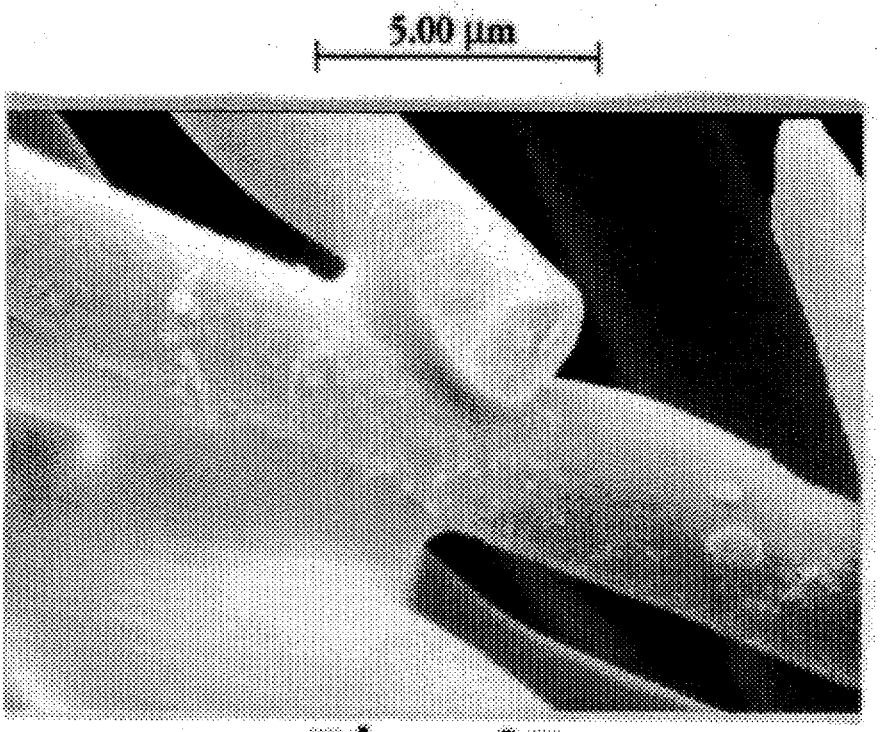

The junction region at the lower center in FIG. 3C is shown at 7,000× magnification in FIG. 4D. The micrograph shows more clearly the textured grain-growth regions of the alumina fibers, and both silica/alumina and alumina/alumina fiber junctions.

C. Panel Properties

The acoustic panel of the invention is designed to provide (i) an effective sound barrier over a wide range of lower frequencies, (ii) surface pore sizes which allows absorption of sound over a wide range of higher frequencies, and (iii) the ability to reflect non-absorbed sound and dissipate absorbed sound.

The property of the panel as a sound barrier, particularly at lower sound frequencies, is related to (i) the relatively high flow resistance of the panel material, and (ii) to its material strength.

In one general embodiment of the invention, the panel has a relatively high flow resistance at both panel sides and a relatively uniform flow between panel sides. The flow resistance at both panel sides is preferably between about 70–500K rayls/m. In this embodiment, the sound-absorbing side of the panel acts as a barrier to sound, particularly in lower-frequency ranges, e.g., at frequencies below about 1,000 Hz.

Figure 4:
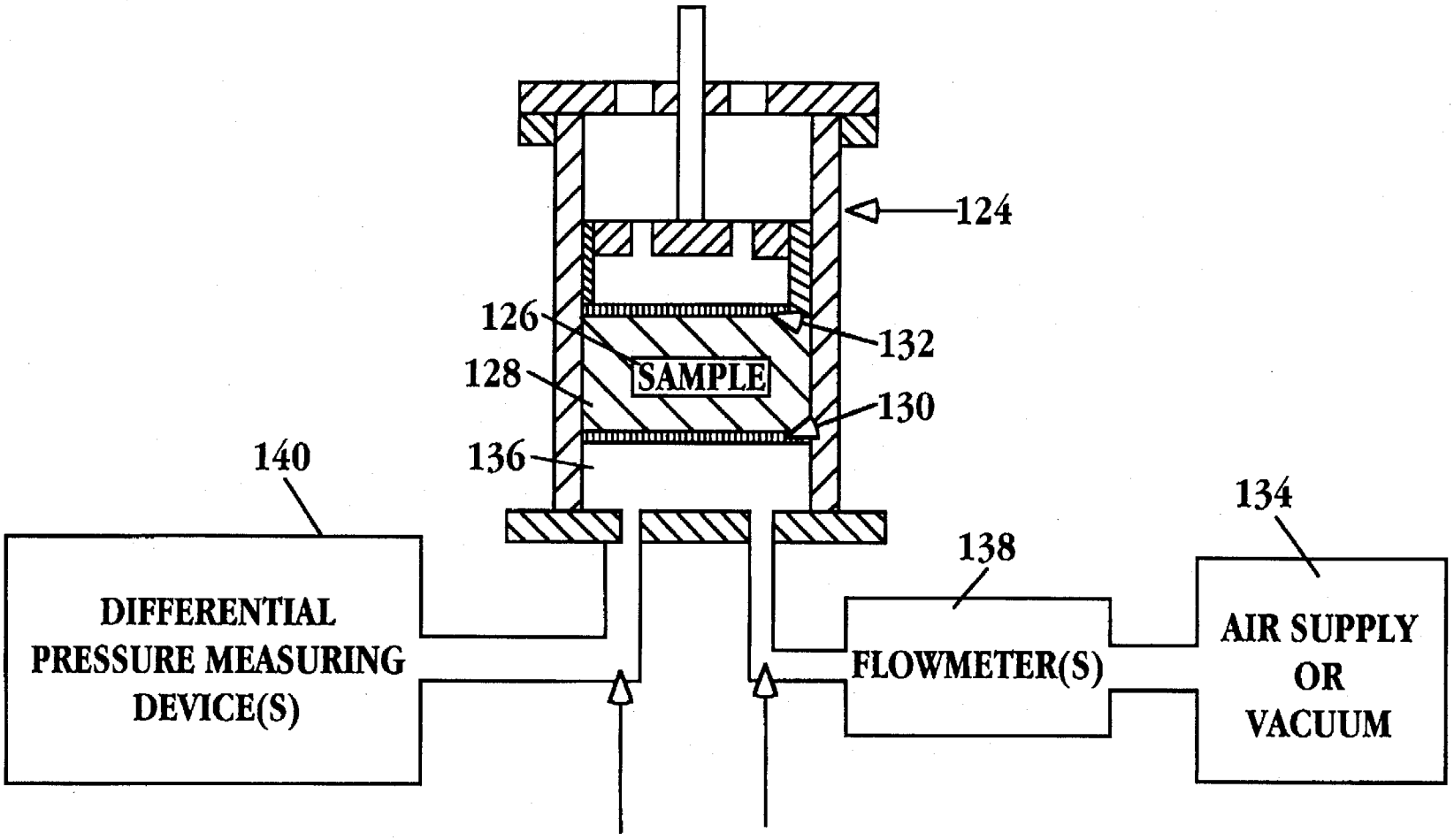
FIG. 4 illustrates a method for measuring air flow resistance in an acoustical panel or panel section.

FIG. 4 shows a device 74 for use in measuring the flow resistance of a sample, here indicated at 76. The device includes a sample chamber 78 for holding the sample between a pair of screens 80. 82. An air supply or vacuum source 84 pumps air into or evacuates air from, respectively, a lower region 86 of the chamber. The rate of air flow between chamber region 86 and source 84 is measured by a flowmeter 88. Chamber region 86 is also in fluid communication with a differential pressure measuring device 90 which measures the pressure differential across the sample.

In operation, source 84 is adjusted to a desired pressure or vacuum level. The resistivity of the sample in the sample chamber is then measured from the pressure differential across the sample and the rate of flow through the device, with high pressure differential measurements and low flow rates being associated with high resistivity, and low pressure differential and high flow rates being associated with low resistivity.

Figure 5:
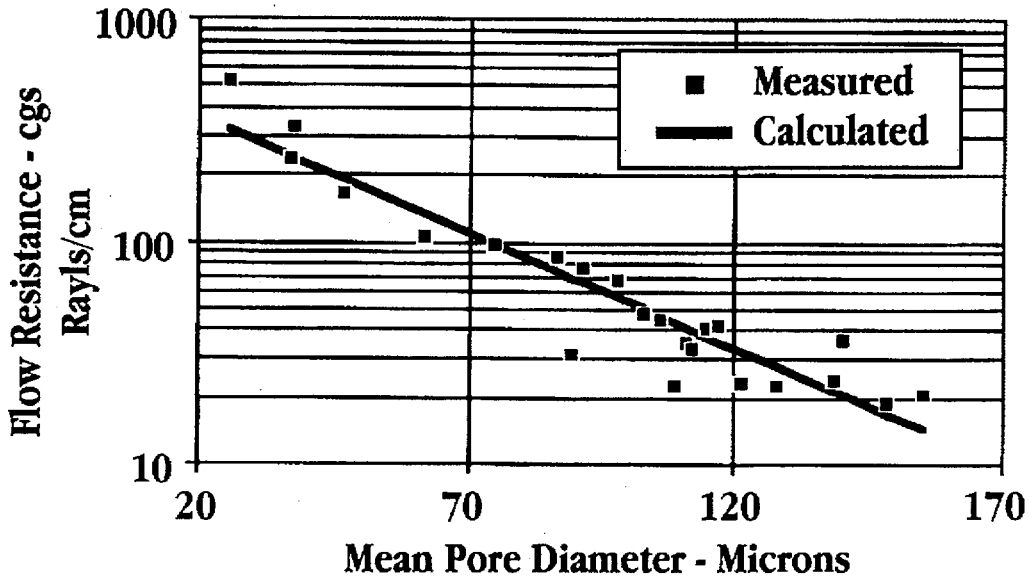
FIG. 5 is a plot showing the relationship between air flow resistance in an acoustical panel constructed in accordance with the invention as a function of average matrix pore size.

FIG. 5 shows the relationship between flow resistivity and mean pore size in a panel constructed in accordance with the invention. The panel matrices examined were formed to have varying bulk densities and/or fiber diameters, as discussed in Section III below. Mean pore size of each matrix was determined by percent intrusion of mercury into a matrix, as a function of mercury intrusion pressure, measured using a Micromeretics PoreSizer 9320 mercury porosimeter. Sample sizes with dimensions of 0.5625 inch diameter by 0.4 inch height were cored from a fused matrix formed in accordance with the invention. The intrusion pressure was varied from 0.15 to 30 psixA (area=1 $in^2$), over 85 points of increasing pressure. From this data, a instrument program calculated the incremental volume (ml/g) intruding into the sample. An internal program is used to calculate a pore diameter in microns for a given pressure level. From this, the mean pore diameter for the sample is determined.

As seen, flow resistance increases logarithmically with decreasing mean pore size over a mean pore size range of about 20–150 μm, with the desired flow resistance in the range between 70–500K rayls/m corresponding to mean pore sizes in the range of about 80–90 μm or less.

Figure 6:
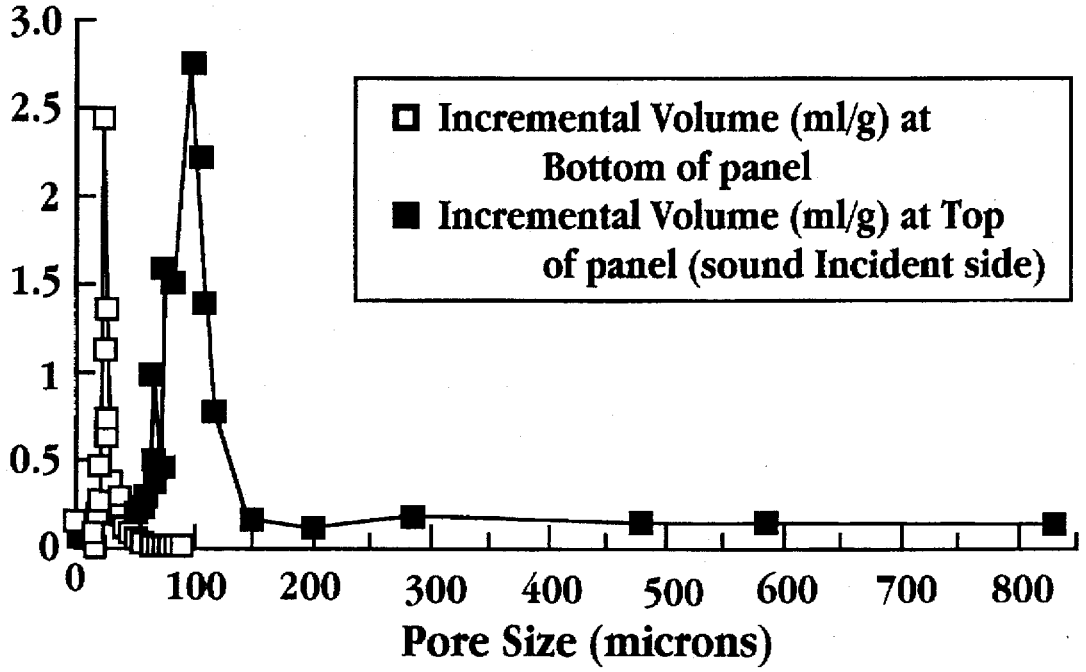
FIG. 6 shows the pore size distribution measured at the sound-absorbing side (closed squares) and at the back side (open squares) of a panel constructed in accordance with the invention.

FIG. 6 shows the distribution of pore sizes in a panel constructed in accordance with the invention, and in particular, a panel having a lower-to-higher density gradient progressing from the panel's sound-absorbing to its back side. As described above, the pore size distribution is determined from the extent of Hg intrusion into a defined-area surface of the panel, at each of a number intrusion pressure from about 0.15 to 30 psiA.

For the sound-absorbing side of the panel, pore sizes ranged from about 0.1 to 850 μm, with a mean pore size of 65.8 μm. With reference to FIG. 5, this mean pore size corresponds to a flow resistivity of about 180K rayls/m. For the back panel side, pore sizes ranged from about 0.1 to 100 μm, with a mean pore size of about 51.2 μm, corresponding to a flow resistivity of about 334K rayls/m. These measurements illustrate how a flow resistivity gradient in a panel constructed in accordance with the invention can be demonstrated.

In addition to high flow resistivity, the barrier properties of the panel also rely on high strength (stiffness). Without material stiffness, or alternatively, material mass, sound pressures that build up by the high resistance on the incoming side of the panel will merely cause the material to move as a unit and transmit this motion into acoustical pressure on the other side of the panel. Stiffness is more desirable than mass, since lighter weight is desirable, particularly for vehicle/aircraft use. The stiffness properties of the material are discussed below.

According to another feature of the panel matrix, the wide range of pore sizes is effective to absorb sound over a broad range of higher frequencies, e.g., above about 1,000 Hz. As already noted, the range of pore sizes in the panel of the invention is between about 0.1 to 100 μm.

Once absorbed, sound waves of a particular frequency are deflected and dissipated by the randomly oriented, fused silica fibers. In particular, the relatively high internal flow resistivity of the material, combined with high material strength, acts to dampen sound waves by localized vibrations within the matrix.

To be effective in dissipating absorbed sound, the material must also have a thickness of at least about one-quarter wavelength. This is to insure that some portion of the wave having high particle velocity is within the dissipative medium. A preferred panel thickness is at least about ½ inch, preferably ½ to 2 inches.

As indicated above, the ability of the panel material to reflect non-absorbed sound, and to dissipate absorbed sound depends on panel-matrix stiffness, due to the fused-fiber construction of the material. One measure of material stiffness is compression modulus, which provides a measure of the material resistance to deformation under a compressive force, measured according to standard methods. The compression modulus of the panel matrix is preferably between 100 and 2,500 psi.

With reference again to FIGS. 1–3, it can be appreciated how the panel of the invention acts to insulate an aircraft against outside noise, e.g., engine noise. In the embodiments shown in FIGS. 1 and 2, sound impinging on the insulating panel from the outside is partially reflected, particularly at lower frequencies, and partially absorbed and dissipated, particularly at higher frequencies. Some of the reflected sound will pass through the fuselage skin, and some will be back reflected at higher frequencies, leading to greater sound absorption.

Because sound that is absorbed tends to be dissipated within the panel, due both to the high flow resistivity of the panel and to its stiffness, the panel provides an effective insulator against outside sound over a broad range of sound frequencies, such as are characteristic of jet engine and high-speed air noises.

In addition to the ability of the panel material to act as a sound insulator, by reflecting non-absorbed sound and dissipating absorbed sound, the panel also has useful properties, particularly in the context of aircraft sound insulation, of (i) rigid construction, (ii) low density, (iii) ability to resist uptake of moisture, and (iv) ability to provide good heat insulation against fire.

The rigid construction of the panel allows its use as a structural wall member, as indicated in the FIG. 2 and FIG. 3 configurations.

The ability of the panel to resist moisture uptake is achieved by coating the fibers making up the matrix with a hydrophobic surface coating, such as a surface coating of an alkyltrialkoxyysilane, such as methyl trimethoxysilane, polyethylene, polystyrene, or polytetrafluoride. Methods for coating the fibers of a matrix with a hydrophobic polymer are considered in Section IV below.

II. Panel with Flow-Resistance Gradient

In a second general embodiment of the invention, the panel matrix has a lower-to-higher flow resistance gradient, progressing in a direction from the sound-absorbing panel side to the back panel side. As will be described, the gradient results from a lower-to-higher density gradient, progressing in a direction from the sound-absorbing to the back side of the panel, and/or to a larger-to-smaller fiber size gradient, progressing in the same direction.

More generally, the panel of the invention may include a rigid matrix of the type described above, having (i) a sound-absorbing sublayer whose flow resistance is between about 20–100K rayls/m, and (ii) a backing sublayer whose fiber sizes are predominantly in the 0.5 to 2 μm diameter size range, and whose flow resistance is at least 50% greater than that of the sound-absorbing sublayer. The two sublayers may form a continuous flow-resistance gradient between opposite panel sides, as described in FIGS. 7 and 8 below, or may be joined at a relatively steep gradient region, as described in FIGS. 9 and 10 below.

FIG. 7 shows a side view of a panel 92 having having a continuous flow-resistance density gradient between its sound-absorbing and opposite sides 94, 96, respectively. In this embodiment, the flow-resistance gradient in the panel is due to a lower-to-higher density gradient on progressing from the sound-absorbing to the opposite panel side. The fibers forming the matrix are preferably in the range 0.5 to 2 μm, although larger fiber diameters, e.g., in the range 1–5 μm may be employed.

Specifically, the fiber sizes should be such as to produce a flow resistance, at the back side of the panel opposite the sound-absorbing side, of between about 70–500K rayls/m, such that the panel can act an effective barrier to sound penetration. The flow resistivity at the sound-absorbing side of the panel is preferably between about 20–100K rayls.

As discussed above with respect to FIG. 6, higher flow resistivity is achieved in the panel of the invention by reducing mean pore size. Mean pore size, in turn, can be reduced by reducing the average fiber diameter size or increasing the matrix density. Therefore, if larger diameter fibers are used, a greater matrix density will be required at the back side of the panel, to achieve the desired high flow resistivity.

FIGS. 8A and 8B illustrate the different fiber densities in front and back regions 98, 100, respectively, of the panel, i.e., regions of the sound-absorbing sublayer and backing sublayer, respectively. As seen, the fibers forming each sublayer, such as fibers 102 forming sublayer 98 and fibers 104 forming sublayer 100 have substantially the same fiber diameters, but are more closely packed in the backing sublayer, producing a lower mean pore size and thus a higher flow resistivity than in the panel's sound-absorbing sublayer.

In the embodiment shown, in which the flow-resistivity gradient is due to a bulk phase density gradient, the density of the panel's backing sublayer is preferably at least about 0.5 $lb/ft^3$ greater than that of the panel's sound-absorbing sublayer, where each sublayer is considered to be a finite-width slice of the panel taken at either panel side. In the density range particularly between 2–3 $lb/ft^3$, this density difference across the panel sides can produce a difference in flow resistivity between the two sublayers of twofold or more, as can be appreciated from FIG. 6B. Methods for forming a panel having a continuous density gradient of this type will be described below in Section V.

Alternatively, or in addition, the continuous flow-resistivity gradient in the panel may be formed by side-to-side variations in fiber diameter sizes, as illustrated for the discontinuous gradient panel now to be described.

FIG. 9 shows a side view of a panel 104 having having a discontinuous flow-resistance density gradient between its sound-absorbing and backing sublayers 104, 106, respectively. The discontinuity, indicated at 106, defines the boundary between the upper sound-absorbing sublayer, indicated at 108, and the lower backing sublayer, indicated at 110.

In this embodiment, the flow-resistance gradient in the panel is due to a larger to smaller fiber diameter gradient on progressing from the sound-absorbing to the back side, i.e., between the sound-absorbing and backing sublayers. In particular, and as illustrated in FIGS. 10A and 10B, the fibers, such as fibers 112, forming the sound-absorbing sublayer are in a size range preferably between about 2–9 μm, more preferably 3–6 μm, and the fibers, such as fibers 114 forming the backing sublayer, are preferably in the size range 0.5–2 μm.

The properties of the gradient panel, as it functions as a sound insulator, are similar to the uniform-matrix panel described in Section I. However, the gradient panel differs in an important respect. Because of the lower flow resistivity of the sound-absorbing face, e.g., less than 100K rayls/m, the panel absorbs more sound, particularly at lower sound frequencies. However, because of the high flow resistivity of the backing sublayer, as well as the stiffness of the panel, absorbed sound is still effectively dissipated as it moves through the panel. In either the continuous or discontinuous gradient embodiments, the backing sublayer, which serves as a barrier to sound penetration, particularly for lower frequency sound, may be a relatively thin portion of the total panel width, for example, ⅛–¼ inch out of a total to 1–2 inch panel. The sound-absorbing sublayer, which functions to absorb and dissipate absorbed sound, is preferably at least about ½ inch, preferably ½ to 2 inches, as discussed above for the uniform panel described in Section I.

III. Sound-Insulation Method

In another aspect, the invention includes a method for reducing the level of sound entering a compartment, such as a vehicle or aircraft compartment, from an external sound source. The method includes shielding the compartment with a one or more panels of the type described in Section I or II, where the sound-absorbing panel side is placed to confront the external sound source.

In one embodiment, illustrated in Section II, the panel matrix has a lower-to-higher flow resistance gradient, progressing in a direction from the sound-absorbing to the back side of the matrix.

In this embodiment, the matrix may have a lower-to-higher density, progressing in a direction from the sound-absorbing to the back side of the lattice, and/or a larger-to-smaller fiber diameter on progressing in the same direction.

As discussed above, the method is effective to reflect impinging sound, particularly at lower frequencies, and to absorb and dissipate sound over a broad range of higher frequencies, providing effective sound insulation over a wide sound frequency spectrum.

IV. Method of Panel Preparation

This section describes the preparation of the acoustical insulator panel of the invention, and in particular, one having a substantially uniform flow-resistivity between its sound-absorbing and opposite sides.

The basic preparation method involves the steps of (i) forming a fiber slurry having desired viscosity and fiber dispersion characteristics, (ii) allowing the slurry to settle under conditions that produce a selected fiber density and orientation, (iii) drying the resulting fiber block, and (iv) sintering the block to form the desired fused-fiber matrix.

A. Fiber Treatment

The silica ($SiO_2$) and/or alumina ($Al_2O_3$) fibers used in preparing the matrix are available from a number of commercial sources, in selected diameters (fiber thicknesses) between about 0.5 and 2 μm, or larger fiber sizes, e.g., 2–8 μm where a panel with a fiber-size gradient is produced, as described below. A preferred silica fiber is a high purity, amorphous silica fiber (99.68% pure), such as fabricated by Manville Corporation (Denver, Colo.) and sold under the fiber designation of "Q-fiber". High purity alumina fibers (average 2.5 to 3.5 μm) may be procured, for example, from ICI Americas, Inc. (Wilmington, Del.).

In a preferred heat treatment, the silica fibers are compressed into panels, e.g., using a Torit Exhaust System and compaction unit. The compressed panels are passed through a furnace, e.g., a Harper Fuzzbelt furnace or equivalent, above 2100° F. for a minimum of 60 minutes, corresponding to a speed setting of about 5.4 inches/minute. The heat treatment is used to close up surface imperfections on the fiber surfaces, making the matrix more stable to thermal changes on sintering. The heat treatment also improves fiber chopping properties, reducing fabrication time. The method is illustrated in Example 1, Part A.

B. Preparing a Fiber Slurry

Silica, and optionally including alumina and/or mullite fibers, from above are blended to form a fiber slurry that is used in forming a "green-state" block that can be sintered to form the desired matrix.

The slurry is formed to contain, in an aqueous medium, silica, or silica and alumina fibers of the type described above, at a fiber:liquid weight ratio of between about 1:20 to 1:200, where the liquid weight refers to the liquid weight of the final slurry preparation. For producing a panel with a uniform density gradient, a relatively low fiber:liquid ratio, e.g., 1:20–1:50 is preferred.

The slurry preferably includes thickening agents effective to give the slurry a viscosity between about 500 and 10,000 centipoise, as measured by standard methods (Example 1). The viscosity agent may be any of a number of well-known hydrophilic polymers, such as polyvinylalcohol, polyvinylacetate, polyvinylpyrrolidone, polyurethane, polyacrylamide, food thickeners, such as gum arabic, acacia, and guar gum, and methacrylate type polymers. The polymers preferably have molecular weights greater than about 25–50 Kdaltons, and are effective to increase solution viscosity significantly at concentrations typically between about 2–50 weight percent (based on total fiber weight) solution. For producing a panel with a relatively uniform matrix density, a relatively high slurry viscosity is preferred.

One preferred thickening agent is Acrylic Acid Polymer, e.g., the polymer sold under the tradename Acrysol ASE-108 and available from Rohm and Haas Company (Philadelphia, Pa.). An acrylate solution used in the method is detailed in Example IB.

The slurry is also preferably formed to contain a source of boron that functions, during sintering, to form a boron/silica or boron/alumina surface eutectic that acts to lower the melting temperature of the fibers, at their surfaces, to promote fiber/fiber fusion at the fiber intersections. In a preferred embodiment, the boron is supplied in the slurry as boron nitride particles 15 to 60 μm in size particles. Such particles can be obtained from Carborundum (Amherst, N.Y.). The amount of boron nitride is preferably present in the slurry in an amount constituting between about 2–12 weight percent of the total fiber weight.

The adhesive property of the thickening agent described above is useful in adhering particles of boron nitride to the fibers in the slurry, to produce a relatively uniform dispersion of particles in the slurry, and to prevent the particles from settling out of the slurry during the molding process described below.

Scanning electron micrographs of a green-state block shows an even distribution of boron nitride particles within the fiber matrix. The even distribution of particles throughout the block is advantageous in achieving effective and relatively uniform boron concentrations throughout the matrix during sintering, as described below.

Fragments of the silica fiber are mixed in a desired weight ratio with alumina fibers, e.g., 10–40 weight percent alumina fibers, and the fibers are dispersed in an aqueous solution containing the dispersing agents. At this point, the fibers are uniformly dispersed in the liquid medium using a low-shear mixer. The boron nitride and acrylate suspension is mixed into the slurry, then a Methocel™ gel stock solution and reagent grade ammonium hydroxide are added as thickening agents to bring the viscosity of the slurry to a desired value between 500–10,000 centipoise. Generally the slurry is not chopped, since a greater degree of chopping produces shorter fibers leading to tighter packing and a less open matrix. Similarly, longer fibers lead to more open matrix structure and lower bulk densities.

The fiber mixing is preferably carried out under condition to produce average fiber sizes of a selected size in the 3–20 mm fiber-length range. After dispersing the fibers uniformly in the liquid medium, the acrylate acid polymer solution and boron nitride suspension is added, then dispersed into the fiber slurry medium using a low shear mixer. The method is illustrated in Example 2A.

C. Forming a Dried Fiber Block

The method of forming a green-state block, i.e., a dried, rigid matrix of unfused fibers, from the above fiber slurry, is illustrated in FIGS. 11A–11D.

Figure 11A:
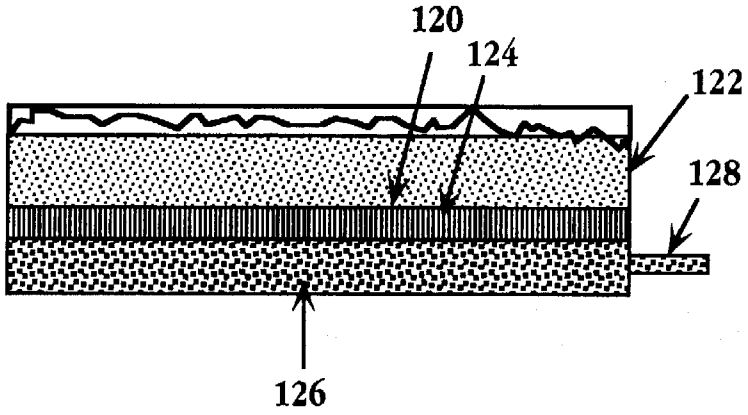
FIGS. 11A–11D illustrate steps in compacting a silica-fiber slurry, in preparing a green-state fiber panel, for use in preparing an acoustic panel in accordance with the invention.

In the first step, illustrated in FIG. 11A, a slurry 120 is added to a mold 122 equipped with a lower screen 124 sized to retain slurry fibers. For fiber sizes (lengths) in the range 1–15 mm, the screen has a mesh size between about 8 to 20 squares/inch. The mold has a lower collection trough 126 equipped with a vacuum drain port 128.

A vacuum of between 4 and 28 inches of mercury is applied to the port. In forming a uniform-density block, it is desirable to employ a compression plate (not shown) placed over the slurry. The compression plate acts to compress the slurry from above, to achieve a relatively uniform fiber packing as the slurry is dewatered. This is in contrast to the method described in the section below for constructing a green-state block with a pronounced top-to-bottom density gradient. In this method, it is desirable to promote fiber packing preferentially at the bottom of the mold, by applying only vacuum (without a packing plate).

Figure 11B:
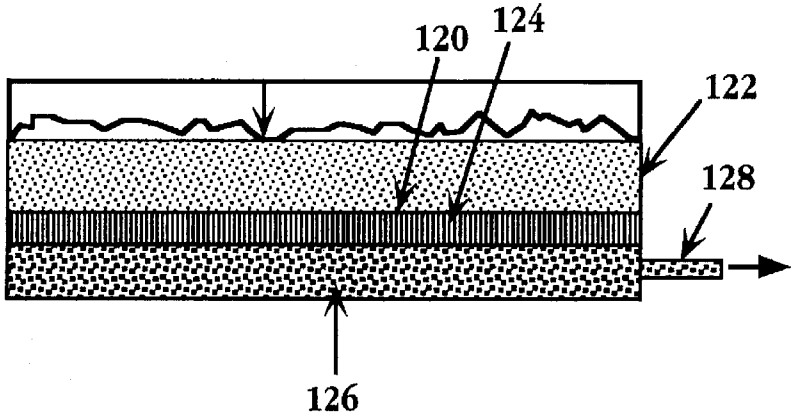

The vacuum is applied over a vacuum forming time, defined as the time required to reduce the slurry to the desired block height, and enough water is removed from the block so that standing liquid is removed from the top of the block, and the vacuum starts to pull air. A total vacuum forming time between about 5 and 300 seconds is sufficient to evacuate the water to form the desired block height, as illustrated in FIG. 11B.

Figure 11C:
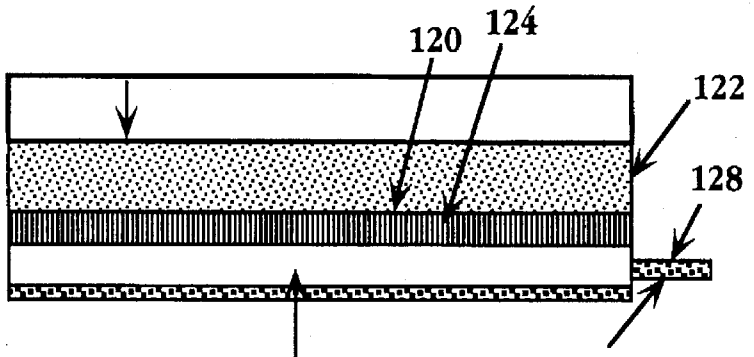
Figure 11D:
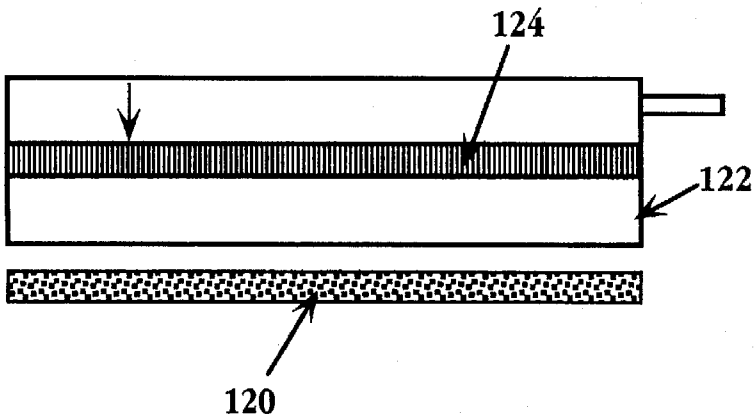

The complete vacuum dewatering process continues for 5 to 15 minutes after the vacuum forming time, until approximately 50% of the water is removed and/or little water is being drawn from the formed matrix, as illustrated in FIG. 11C.

Finally, the dewatered panel is removed from the mold (FIG. 11D), placed onto a handling fixture, such as a metal plate, to prevent block damage during handling. The wet block is dried in an oven, typically at a temperature between 150°–500° F.

In the dried matrix, the viscosity agent acts to bond the fibers at their intersections, forming a rigid, non-fused panel. The target density of the matrix after drying is between about 1.8 to 5.5 pounds/ft$^3$. Details of the molding and drying steps, as applied to producing an exemplary silica/alumina fiber block, are given in Example 2, Parts A and B.

The green-state block may be formed to include sacrificial filler(s) that will be vaporized during sintering, leaving a random dispersion of desired voids in the final fused matrix panel. The fillers are preferably formed of polymer or graphite. In the embodiment of the invention in which the panel matrix has a uniform flow resistivity throughout, the sacrificial filler is uniformly dispersed throughout the slurry used in forming the green-state block.

D. Fused Fiber Matrix

In the final step of matrix formation, the green-state block from above is sintered under conditions effective to produce surface melting and fiber/fiber fusion at the fiber crossings. The sintering is carried out typically by placing the green-state block on a prewarmed kiln car. The matrix is then heated to progressively higher temperature, typically reaching at least 2,000° F., and preferably between about 2,200–2,400° F., until a desired fusion and density are achieved, the target density being between 2 to 5 pounds/ft$^3$. One exemplary heating schedule for a silica/alumina matrix is given in Example 2C.

In a preferred method, discussed above, the matrix is formed with high-purity silica and alumina fibers that contain little or no contaminating boron. In order to achieve fiber softening and fusion above 2,000° F., it is necessary to introduce boron into the matrix during the sintering process, to form a silica/boron or alumina/boron eutectic mixture at the fiber surface. Boron is preferably introduced, as detailed above, by including boron nitride particles in the green-state block, where the particles are evenly distributed through the block.

During sintering, the boron nitride particles are converted to gaseous $N_2$ and boron, with the released boron diffusing into the surface of the heated fibers to produce the desired surface eutectic, and fiber fusion. The distribution of boron nitride particles within the heated panel ensures a relatively uniform concentration of boron throughout the matrix, and thus uniform fusion properties throughout.

Also during fusion, the viscosity agent and dispersant agents used in preparing the green-state block are combusted and driven from the block, leaving only the fiber components.

Where the green-state panel has been constructed to include a high content (greater than 25 percent) of sacrificial element, an intermediate temperature treatment is required to effectively ensure all the sacrificial fibers are vaporized during sintering. In sacrificial element concentrations of less than 25 percent, the high temperature sintering is also effective to vaporize this element, leaving desired voids in the matrix, such as voids randomly distributed throughout the panels upper surface that is subjected to the sound waves (Section V below).

Example 5 illustrates the preparation of a fused-silica matrix containing 30% sacrificial fibers. It will be appreciated that the presence of sacrificial fibers, by effectively expanding the void space in the matrix, can be used to reduce matrix density in a systematic way.

After formation of the fused-fiber matrix in flat, curved or complex shape, the matrix panel may be machined to produce the desired finished contours and configuration.

E. Waterproofing

The matrix is waterproofed to prevent moisture or water absorption into the panel. A chemical vapor infiltration process, as detailed in Example 4, is used to vaporize the methyltrimethoxysilane solution, which in the presence of a dilute acetic acid solution (catalyst) hydrolyzes the silane to react with active sites on the fibers and causes a self-polymerization to occur. The mono layer coating changes the surface tension of the individual fibers to make them hydrophobic which prevents any water molecules from wetting the fiber surface or absorbing into the bulk fused fiber matrix. Successful application of the waterproofing agents prevents moisture or water absorption into the matrix up to approximately 1050° F.

Waterproofing agents that possess film-forming characteristics over the fiber matrix are preferred, e.g., methyltrimethoxysilane (MTMS), hexa-methyl-disilazane (HMDS), dimethylethoxyl (DMES), disilazane are examples of silane compounds applicable for waterproofing the rigid fibrous matrix. Other film-forming chemicals such as the commercially available product Scotchguard™, which are externally applied, provide limited moisture and water absorption protection (less than 100 percent effective). The preferred waterproofing agent for this application is a methyltrimethoxysilane, commercially manufactured by Dow Corning under the product name DC-Z6070.

V. Forming a Panel with a Flow-Resistivity Gradient

The invention also provides improvements in the above panel-forming method, for forming panels having a flow-resistivity gradient between its sound-absorbing and back side.

A. Matrix with a Density Gradient

As discussed in Section III, with reference to FIGS. 7 and 8, the flow-resistivity gradient may be produced by a matrix density gradient between front and back panel sides. Preferably the matrix density at the back of the matrix, or in the backing sublayer, is at least about 0.5 lb/ft$^3$ higher than that of the panel's sound absorbing side or sublayer.

A panel of this type can be produced, in accordance with the invention, by a modification of the panel-forming method described with reference to FIGS. 12A–12D. The modification is designed to produce greater initial packing of the slurry, in the lower region of the mold, and consequently less packing at the upper region of the mold.

In one embodiment, this slurry packing feature is achieved by reducing the fiber:water ratio of the slurry, typically to a range of about 1:80 to 1:400. The more dilute slurry tends to become more highly compacted in its lower region, with vacuum removal of water in the mold, because a greater amount of water is being pulled through the compacting slurry. This greater packing at the lower portion of the mold, in turn, reduces the rate of water removal from the slurry, producing progressively looser packing as more of the slurry becomes dewatered.

At the same time, the viscosity of the slurry is preferably made relatively low, preferably in the range between about 500 and 1,000 centipoise. The lower viscosity assures that the fibers in the slurry will settle readily under gravity during initial dewatering, to form a relatively high fiber density at the bottom of the mold.

In an alternative embodiment, a fiber density gradient in the settling slurry is established by compacting the slurry under a relatively low vacuum. The lower vacuum causes a slower rate of water removal from the slurry, allowing more fiber settling under the influence of gravity, and therefore greater fiber compaction at the initial stages of water removal from the slurry. As above, initial fiber compaction leads to a reduced rate of water removal, producing progressively less packing in the remaining slurry.

As noted above, typical vacuum pressures applied to the mold during slurry compaction are between about 16–28 inches of Hg, typically about 20–26 inches of Hg. In forming a block with a fiber density gradient, the vacuum is reduced typically to between about 7–14 inches of Hg. As indicated above, slurry viscosity and fiber:water ratio, in addition to vacuum, will determine the rate of settling of the fibers, and thus the gradient produced in the block.

In still another approach, the matrix density gradient is formed by introducing sacrificial fibers or particles into the upper portion of the slurry, after a substantial portion of the slurry has already settled. The sacrificial material is added to create a upper sublayer in a green-state block (i) containing preferably between about 20–40 by weight sacrificial material, (ii) a total thickness of at least about ½ inch, and (iii) a continuous-gradient interface with the lower portion of the block.

In this embodiment, the green-state block itself may be formed to have a relatively uniform density throughout, since the reduced fiber density is created during sintering, when the sacrificial material in the upper (sound-absorbing) sublayer of the mold is vaporized.

More generally, this embodiment of the invention is an improvement in a method of preparing a rigid, fused-silica matrix, by the steps of (a) forming a slurry composed of (i) silica fibers having selected fiber thicknesses and a selected fiber:liquid weight ratio, (ii) thickening agents effective to give the slurry a selected viscosity, and (iii) boron nitride particles, in an amount between about 2 and 12 percent by weight of the total fiber weight, where the slurry contains silica fibers, a dispersing agent effective to enhance the dispersion of silica fibers in the slurry, (b) allowing the slurry to settle in a mold under conditions effective to produce a fiber block, and (c) drying the settled block to form a substantially dehydrated fiber block, and (d) heating the dehydrated block to a temperature of at least about 2200° F. for a period sufficient to cause the silica fibers to form a fused-fiber matrix.

The improvement includes selecting fiber sizes predominantly in the 0.5 to 2 μm size range for preparing the slurry, and allowing the slurry to settle under conditions effective to produce a density gradient in the fiber block in which the lower portion of the block has a density of at least about 0.5 lb/ft$^3$ greater than that of the upper portion of the block, and the average density of the block is between about 2 and 6 lb/ft$^3$.

B. Matrix with a Fiber-Size Gradient

As discussed in Section III, with reference to FIGS. 9 and 10, the flow-resistivity gradient may be produced by a fiber-size density gradient between front and back panel side, with smaller fiber sizes on progressing from the sound-absorbing to the back side of the matrix panel.

A panel of this type can be also be produced, in accordance with the invention, by a modification of the panel-forming method described with reference to FIGS. 12A–12D. The modification is designed to produce a green-state block with fiber diameters preferably in the size range between 0.5 and 2 μm in the lower block sublayer, and fiber diameters preferably above about 2 μm, typically 3–8 μm, in an upper block sublayer, with a smooth or continuous fiber-size gradient between the two sublayers.

In preparing a panel of this type, a slurry with the smaller-size fibers is introduced into a mold, and partially compacted under vacuum, as above. At this stage, a second slurry containing the larger-diameter fibers is added, preferably with some stirring of the interface to produce localized mixing of the smaller and larger fibers. The two slurries are then compacted, and dewatered, as above, to form the desired green-state block for sintering.

More generally, this embodiment of the invention is an improvement in a method of preparing a rigid, fused-silica matrix, by the steps of (a) forming a slurry composed of (i) silica fibers having selected fiber thicknesses and a selected fiber:liquid weight ratio, (ii) thickening agents effective to give the slurry a selected viscosity, and (iii) boron nitride particles, in an amount between about 2–12 percent by weight of the total fiber weight, where the slurry contains silica fibers, a dispersing agent effective to enhance the dispersion of silica fibers in the slurry, (b) allowing the slurry to settle in a mold under conditions effective to produce a fiber block, and (c) drying the settled block to form a substantially dehydrated fiber block, and (d) heating the dehydrated block to a temperature of at least about 2200° F. for a period sufficient to cause the silica fibers to form a fused-fiber matrix.

The improvement includes selecting fiber sizes predominantly in the 0.5 to 2 μm size range for preparing the slurry, allowing the slurry to settle partially, then adding a second slurry composed of larger-diameter fibers, and compacting and dewatering the slurry mixture to form a fiber block for sintering.

The following examples are intended to illustrate methods for forming and testing an acoustical panel formed in accordance with the invention, but are in no way intended to limit the scope of the invention.

EXAMPLE 1

Forming a Fiber Slurry

A. Fiber Pretreatment

The silica fibers were heat treated as described above. The bulk fiber is compressed into panels, e.g., using a Torit Exhaust System and compaction unit. The compressed panels are passed through a furnace, e.g., a Harper Fuzzbelt furnace or equivalent at 2150° F. for a minimum of 60 minutes, corresponding to a speed setting of about 5.4 inches/minute. The heat treatment is used to close up surface imperfections on the fiber surface, making the matrix more stable to thermal changes during fusion.

B. Preparation of Stock Acrylate Solution

The acrylate stock was prepared for dispersing the boron nitride powder into the fiber slurry. 18 parts by weight of acrylic acid polymer (Acrysol ASE-108 from Rohm Haas) was dissolved in 80.2 parts by weight deionized water (1 megohm) using a spatula. Ammonium hydroxide (reagent grade 28–30% W) at 1.80 parts by weight was added to the mixture during the stirring to help dissolve the acrysol. Mixing was continued until almost all the milkiness color was gone. Preparation of the stock solution is performed at room temperature of 68°±2° F.

Upon completion of mixing, the solution's viscosity was measured after a 24 hour waiting period. Using a Brookfield Synchro-Lectric Viscometer (Model LVT) with a number 3 spindle installed in the instrument, an appropriate sample size was adjusted for a temperature of 75°±5° F. The viscosity expressed in centipoise was measured a four spindle speeds (0.3, 0.6, 3 and 30 rpm) in ascending order. The solution must have the minimum viscosity reading defined in the table below.

| Spindle Speed (rpm) | Minimum Viscosity (Centipoise) |
|---|---|
| 0.3 | 32,000 |
| 0.6 | 24,000 |
| 3 | 12,000 |
| 30 | 4,000 |

C. Preparation of Gel Stock

A gel stock was prepared for use as a thickening agent in the fiber slurry. A 2 parts by weight methyl cellulose (Methocel A4M commercial grade powder from Dow Chemical Co.) was dissolved in 98 parts by weight, of hot deionized water (1 megohm) and vigorously stirred to produce a homogeneous solution. The methyl cellulose solution was slowly gelled by placing the mixture container in an ice bath with a maximum temperature of 45° F., for a minimum time of 40 minutes. Upon completion of gelling, the solution's viscosity was measured using a Brookfield Synchro-Lectric Viscometer (Model LVT) with a number 1 spindle installed in the instrument.

Prior to testing the appropriate sample size was adjusted for temperature to 68°±2° F. while stirring slowly to avoid air entrapment. Viscosity measurements were recorded at one spindle speed (0.6 rpm) and expressed in centipoise. The solution should have a minimum viscosity of about 4000 centipoise.

D. Preparing a Fiber Suspension

A suspension of boron nitride and acrylate stock solution from Part B above was prepared by thoroughly mixing the constituents together. The weight percentages of the boron nitride was measured from between 2 and 12 percent of the total fiber weight.

The acrylate stock solution from Part B was added from between 5–30 percent of the total fiber weight. The stock solution is used to attach the boron nitride powder to the fibers, increase the slurry viscosity, and provide the dehydrated green-state block with low-temperature strength for handling.

E. Mixing the Fibers

The silica/alumina fiber compositions were placed into a partially filled mixing container filled with deionized water and a wetting agent, such as Darvon 821A, was added at a concentration of 0.2 to 5 percent by liquid weight to enhance fiber dispersion. The remaining DI water was added until the desired fiber:water ratio was achieved. The slurry was mixed using a variable low-shear double impeller blade to disperse, but not chop, the fibers and allowed to age for an appropriate time (typically 1–24 hours; aging greater than 24 hours may be required for fiber diameter sizes from 0.5–1 microns). The boron nitride and acrylate stock solution suspension was added and blended into the slurry. A gel stock solution prepared in Section C was added in a concentration of 2–30 percent by weight of the total fibers. A reagent-grade ammonium-hydroxide (25%) at a volume of 0.1 to 1 ml per pound of fibers was added to stabilize the slurry viscosity, and the slurry was transferred to the vacuum forming mold.

EXAMPLE 2

Preparation of Fused-Fiber Matrix

A. Forming the Fiber Slurry

The vacuum forming system used to form the matrix is equipped with a variable vacuum drain control to 28 inches of mercury.

The fiber slurry was transferred into the forming tank equipped with a paddle mixer. The mixer is used to stir the slurry to keep the fibers from settling between block forming. The vacuum forming mold is placed into the slurry with the screen side up. Once the mold is immersed in the slurry vacuum is applied to the mold so that he fibers are drawn into the mold and compacted. When the desired fiber height is achieved the forming mold is raised out of the forming tank. The vacuum forming time ranges from 5 sec to 300 sec, and is timed when the vacuum is first applied to when the standing water is drained from the top of the block.

The vacuum is continued (dewatering step) until about 50 percent of the remaining water is removed from the block, or little water can be pulled from the block. The dewatering period typically ranges from 5–30 minutes.

B. Drying the As-Cast Matrix

The as-cast matrix was placed on an Armalon lined handling fixture mounted on a baker's cart, and dried in an electrically heated drying oven set between 150° F. to 500° F. for a minimum of 16 hours. The target density of the matrix after drying is between 1.8 to 5.5 pcf.

C. Fusion of the Matrix

The dried matrix was sintered above 2200° F. using a bottom loading Harper Elevator Kiln or equivalent; equipped with a programmable controller, to achieve fired densities between 2.0 to 5.0 pcf. Kiln cars were pre-warmed to increase temperature uniformity in the kiln and around the materials being fired. The firing schedule includes the following ramp rates, temperature settings, and estimated soak times.

| Ramp | Temp | Soak Time |
|---|---|---|
| start | 1800° F. | 12 minutes |
| 2° F./min | 1900° F. | 6 minutes |
| 1° F./min | 2100° F. | 6 minutes |
| 2° F./min | 2200° F. | as required to achieve target density |

The kiln was then cooled to 1800° F. prior to kiln car removal. The panel is cooled to below 200° F. and the fused matrix is removed from the car.

EXAMPLE 3

Panel Containing 78% Silica Fiber and 22% Alumina Fiber 91.1 pounds of high purity (99.68+%) heat treated silica fibers (Schuller, code 108 "Q" fibers, 1.2 μm to 1.8 μm in diameter) and 25.7 pounds of alumina fibers (2.5 to 3.5 microns in diameter, ICI America) were dispersed in 686 gallons of deionized water (approximately 5722 pounds) and mixed for 240 minutes using a low-shear double propeller mixer at 500 rpm.

A dispersion mixture of 3.3 pounds boron nitride powder (325 mesh, Type SHP, Carborundum) and 11.7 pounds of a stock acrylate solution was added to the mixing tank. 30 pounds of a 2 percent methocel solution (Rohm and Haas) was added and mixed into the slurry for 10 minutes. Next, the fiber slurry mixture was dumped into the forming tank and 17.5 milliliters of reagent grade ammonium hydroxide was mixed into the forming tank for 25 minutes. The vacuum forming mold was submerged into the forming tank screen side up, allowing the slurry to fill the mold. The slurry was compressed using 17 inches of mercury for 5 seconds to fabricate a 2 inch thick panel. The mold was raised out of the tank with the vacuum pressure on to remove excess water from the panel. When very little water could be withdrawn from the panel (~50 percent of water removed), the vacuum was turned off.

The panel, 27"×27"×~2" thick in size, was removed from the mold and dried for a minimum of 48 hours at 350° F. The dry density of the panel was 3.91 pcf (0.06 g/cc). The block was fired at a ramp rate of 2° F./minute to 2350° F. for 30 minutes. The fired density of the block was 4.50 pcf (0.08 g/cc).

The median pore size for the front surface of the panel was 65.8 microns as measured by the mercury porosimetry method having an air flow resistivity of 179,713 mks rayls per meter per ASTM C522-87. The back surface median pore size was measured at 51.2 microns and the air flow resistivity measured at 334,332 mks rayls per meter.

EXAMPLE 4

Waterproofing a Panel

Finished panels are waterproofed using a chemical vapor infiltration (CVI) process to apply the methyltrimethoxysilane solution. The methytrimethoxysilane vapors deposit a thin film coating over each fiber that changes its surface tension; making the fibers hydrophobic. The resulting process causes the water droplets to bead on the panel surface rather than be absorbed into the high porosity open cell structure.

The panels are placed inside a temperature controlled vacuum oven having ±15° F. control capability. The oven is closed and evacuated to remove its air content. The chamber is heated to 350°±10° F. Once evacuated to greater than 29 inches of Mercury, the oven is purged with nitrogen gas. The oven is re-evacuated to more than 29 inches of Mercury. The exterior reservoirs are evacuated of air and purged with nitrogen gas. Dilute acetic acid solution (45 ml) is added to one reservoir and 225±5 ml of silane in the other. The dilute acetic acid solution is prepared by carefully mixing 50 parts by volume of glacial acetic acid to 100 part by volume deionized water in a clean plastic or glass container. The solution is slowly mixed and stirred.

After adding the acetic acid solution and silane to their respective reservoirs; the caps are closed and the acetic acid solution is heated to 350°±10° F. and the silane heated to 375°±10° F., respectively. Once the acetic acid is vaporized and the pressure inside the reservoir reads 20 psi, minimum, the vapors are released into the vacuum chamber (previously evacuated to greater than 29 inches of mercury and held steady at 350°±10° F.). The valve is kept open until the vacuum pressure in the oven has stabilized for 15 seconds. After a 5 minute timer is set and goes off; and the silane reservoir pressure reads greater than 20 psi, minimum; the silane vapors are released into the vacuum chamber. A timer is set for 60 minutes. When the pressure stabilizes in the vacuum chamber, the silane injector valve is closed. After the 60 minute timer goes off, nitrogen is purged through the system then evacuated. The nitrogen purge and evacuation is repeated 4 more times to ensure all silane vapors (extremely hazardous) have been removed. After the last evacuation, air is slowly bled into the chamber until the vacuum gauge reads zero. The valves are closed and the chamber door opened and the panels removed. The waterproofing process can be repeated a maximum of one more time as necessary to ensure water resistance of the ceramic panels.

While the invention has been described with reference to specific methods and embodiments, it will be appreciated that various modifications and changes may be made without departing from the invention.

It is claimed:

1. A rigid acoustic insulator panel for use as a sound barrier comprising a rigid matrix defining a sound-absorbing panel side and a back side, said matrix (i) being formed of randomly oriented, fused silica fibers having fiber diameters predominantly in the range between 0.5 and 2 μm, (ii) having a three-dimensionally continuous network of open, intercommunicating voids, and (iii) having a density of between about 2 and 6 lb/ft$^3$.

2. The panel of claim 1, wherein the matrix is formed of fused silica and alumina fibers, where the alumina fibers make up 10–40 percent of the total fiber weight of the matrix.

3. The panel of claim 1, wherein the fibers are coated with a hydrophobic film effective to reduce water penetration into the matrix.

4. The panel of claim 1, which has a flow resistance between about 70–500K rayls/m at its sound-absorbing side.

5. The panel of claim 4, wherein the matrix has a lower-to-higher flow resistance gradient, progressing in a direction from the sound-absorbing to the back side of the matrix.

6. The panel of claim 5, wherein the matrix has a lower-to-higher density, progressing in a direction from the sound-absorbing to the back side of the matrix.

7. The panel of claim 5, wherein the matrix has a larger-to-smaller fiber size gradient, progressing in a direction from the sound-absorbing to the back sides of the matrix.

8. The panel of claim 1, wherein the diameters of the fibers forming the matrix are predominantly in the 0.5 to 1.5 μm range.

9. A sound-absorbing panel for use as a sound barrier, comprising a rigid matrix of randomly oriented, fused silica fibers which form a three-dimensionally continuous network of open, intercommunicating voids, with a matrix density of between about 2 and 6 lb/ft$^3$, said matrix having a sound-absorbing sublayer (i) whose flow resistance is between about 20–100K rayls/m, and a backing sublayer whose fiber sizes are predominantly in the 0.5 to 2 μm diameter size range, and (ii) whose flow resistance is at least 50% greater than that of the sound-absorbing sublayer.

10. The panel of claim 9, wherein the matrix is formed of fused silica and alumina fibers, where the alumina fibers make up 10–40 percent of the total fiber weight of the matrix.

11. The panel of claim 9, wherein the fibers are coated with a hydrophobic film effective to reduce water penetration into the matrix.

12. The panel of claim 9, wherein the two sublayers form a continuous gradient of flow resistance between them.

13. The panel of claim 12, wherein the density of the material in the sound-absorbing layer is at least about 0.5 lb/ft$^3$ less than that of the backing sublayer.

14. The panel of claim 9, wherein the two sublayers form a discontinuous gradient of flow resistance between them.

15. The panel of claim 14, wherein the density of the material in the sound-absorbing layer is at least about 0.5 lb/ft$^3$ less than that of the backing sublayer.

16. The panel of claim 9, wherein the backing sublayer contains a higher percentage of fibers in the 0.5–2 μm size range than the sound-absorbing layer.

17. A method for reducing the level of sound entering a compartment, such as a vehicle or aircraft compartment, from an external sound source, comprising shielding the compartment with one or more panels, each composed of a rigid matrix defining a sound-absorbing panel side placed to confront the external sound source, and an opposite back side, where the matrix (i) is formed of randomly oriented, fused silica fibers having fiber diameters predominantly in the range between 0.5 and 2 μm, (ii) has a three-dimensionally continuous network of open, intercommunicating voids, and (iii) has a density of between about 2 and 6 lb/ft$^3$.

18. The method of claim 17, wherein the matrix has a lower-to-higher flow resistance gradient, progressing in a direction from the sound-absorbing to the back side of the matrix.

19. The method of claim 18, wherein the matrix has a lower-to-higher density, progressing in a direction from the sound-absorbing to the back sides of the matrix.

* * * * *